US005574483A

United States Patent [19]

Nishizawa

[11] Patent Number: 5,574,483

[45] Date of Patent: Nov. 12, 1996

[54] DISPLAY CONTROL UNIT AND DISPLAY CONTROL METHOD THEREOF

[75] Inventor: Yoshiyuki Nishizawa, Hadano, Japan

[73] Assignee: Ricoh Company, Ltd., Tokyo, Japan

[21] Appl. No.: 115,038

[22] Filed: Sep. 1, 1993

[30] Foreign Application Priority Data

Sep. 3, 1992 [JP] Japan ..... 4-235691

[51] Int. Cl.[6] ..... G09G 5/00

[52] U.S. Cl. ..... 345/200; 345/203

[58] Field of Search ..... 345/200, 201, 345/203, 185, 189, 190, 87, 89, 97, 98, 100, 120, 126, 27, 28; 348/411, 412, 415, 430, 717, 790, 791, 794; 395/164–166

[56] References Cited

U.S. PATENT DOCUMENTS

| | | | |
|---|---|---|---|
| 4,150,397 | 4/1979 | Russell | 348/415 |
| 4,232,376 | 11/1980 | Dion et al. | 345/28 |
| 4,414,628 | 11/1983 | Ahuja et al. | 345/201 |
| 4,694,347 | 9/1987 | Ito | 348/794 |
| 4,701,026 | 10/1987 | Yazaki et al. | 345/97 |
| 4,792,981 | 12/1988 | Cahill, III et al. | 348/126 |
| 4,823,108 | 4/1989 | Pope | 345/120 |
| 4,864,290 | 9/1989 | Waters | 345/89 |
| 4,870,479 | 9/1989 | Dubner | 348/717 |
| 5,111,317 | 5/1992 | Coulson | 345/97 |
| 5,363,500 | 11/1994 | Takeda | 345/185 |

FOREIGN PATENT DOCUMENTS

| | | |
|---|---|---|
| 59-2081 | 1/1984 | Japan . |
| 2217893 | 8/1990 | Japan . |
| 2292629 | 12/1990 | Japan . |

*Primary Examiner*—Steven Saras

*Attorney, Agent, or Firm*—Oblon, Spivak, McClelland, Maier & Neustadt, P.C.

[57] ABSTRACT

A display control unit has a display data memory such as a video RAM for storing display data displayed in pixels of a display unit and has a control section for repeatedly reading the display data stored to the display data memory when the display data are outputted to the display unit. The control section has a bit judging section for judging whether all bits of the display data read at one time from the display data memory are the same or not and has a status memory for storing judging results of the bit judging section and a bit kind of the display data judged as the same bits. The control section confirms registered contents of the status memory and reads the bit kind registered to the status memory instead of the display data stored to the display data memory when all the bits of the display data are the same. In accordance with this structure, power consumption of the display control unit is reduced by reducing the number of reading operations of the display data from the video RAM. A display control method for controlling an operation of the display control unit is also shown.

6 Claims, 8 Drawing Sheets b7
b6
b0
b15
b9
b8
7a
VIDEO RAM (RED)
7b
VIDEO RAM (GREEN)
7c
VIDEO RAM (BLUE)
FIRST LINE
SECOND LINE
480TH LINE
31
WHITE
CYAN
MAGENTA
BLUE
YELLOW
GREEN
RED
BLACK
YELLOW

DISPLAY CONTROL UNIT AND DISPLAY CONTROL METHOD THEREOF

BACKGROUND OF THE INVENTION

1. Field of the Invention

The present invention relates to a display control unit for transmitting display data to a display unit composed of a liquid crystal display (LCD), etc. on the basis of commands from a central processor. More particularly, the present invention relates to a display control unit and a display control method thereof suitably applied to devices requiring low power consumption such as a portable word processor and a personal computer, etc. operated by a battery.

2. Description of the Related Art

A personal computer, a word processor, etc. operated by a battery are developed to reduce power consumption such that the personal computer, the word processor, etc. can be operated for a long time.

For example, Japanese Patent Application Laying Open (KOKAI) No. 59-2081 shows a general technique for reducing power consumption of a display control unit. In this technique, power consumption is reduced by generally controlling each of display operations of a composite display plasma display panel (PDP) for providing a plurality of displays such as a segment display, a dot matrix display, etc. For example, Japanese Patent Application Laying Open (KOKAI) No. 2-292629 shows a control operation of the display control unit in which a central processor gets access to video RAMs. A speed of this control operation is increased by frequently changing addresses of the video RAMs when display data are accessed.

However, in such a general technique, no access control to the video RAMs is considered with respect to display data in which the same contents are continuously displayed. For example, characters are scattered as a whole when the characters are printed on the left-hand side of a document made by a word processor and blanks are formed on the right-hand side of the document. Characters are also scattered as a whole when table calculating soft or spreadsheet soft is used. In such cases, continuous dots often have the same color in a picture portion of a display unit. In the general technique, data are also read from the video RAMs with respect to such a picture portion in which the same color is continuously displayed, thereby consuming a large amount of power.

Accordingly, when display data are outputted to the display unit in the general technique, the video RAMs are accessed at any time irrespective of displayed contents, i.e., data contents of the video RAMs. Therefore, it is impossible to reduce power consumption of the display control unit by getting access to the video RAMs.

SUMMARY OF THE INVENTION

It is therefore an object of the present invention to provide a display control unit and a display control method thereof in which it is not necessary to read data from a video RAM in a picture portion continuously having the same image contents, and power consumption is reduced by reducing the number of accesses to the video RAM.

In accordance with a first structure of the present invention, the above object can be achieved by a display control unit comprising a display data memory for storing display data displayed in pixels of a display unit; and control means for repeatedly reading the display data stored to the display data memory when the display data are outputted to the display unit; the control means including bit judging means for judging whether all bits of the display data read at one time from the display data memory are the same or not; and a status memory for storing judging results of the bit judging means and a bit kind of the display data judged as the same bits; the control means confirming registered contents of the status memory and reading the bit kind registered to the status memory instead of the display data stored to the display data memory when all the bits of the display data are the same.

In accordance with a second structure of the present invention, the control means and the status memory are constructed by one IC chip.

In accordance with a third structure of the present invention, the above object can be also achieved by a method for controlling the operation of a display control unit, the display control unit comprising a display data memory for storing display data displayed in pixels of a display unit; and control means for repeatedly reading the display data stored to the display data memory when the display data are outputted to the display unit; the control means including bit judging means for judging whether all bits of the display data read at one time from the display data memory are the same or not; and a status memory for storing judging results of the bit judging means and a bit kind of the display data judged as the same bits; the display control method comprising the steps of confirming registered contents of the status memory by the control means and reading the bit kind registered to the status memory by the control means instead of the display data stored to the display data memory when all the bits of the display data are the same; and performing a registering operation of the status memory when the display data are stored to the display data memory.

In accordance with a fourth structure of the present invention, the control means and the status memory in the third structure are constructed by one IC chip.

In the present invention, the display control unit confirms whether all bits of the display data are the same or not on the basis of the registered contents of the status memory when the display data are outputted to the display unit. If all the bits of the display data show the same value "1" or "0", a reading operation of the display data memory about the display data is stopped and registered data of the status memory indicative of value "1" or "0" are read from this status memory. Thus, i t is not necessary to get access to the display data memory so that power consumption of the display data memory can be reduced. Further, it is possible to reduce power consumption in a circuit portion operated at a high frequency until data of the display data memory are converted to serial data.

A capacity of the status memory can be reduced so that the status memory can be assembled into one integrated circuit as a display controller together with the other constructional parts. Thus, it is not necessary to dispose an output driver for the status memory so that power consumption for reading data from the status memory can be reduced.

Further, power consumption of the display control unit can be reduced by registering the display data to the status memory at a recording time of the display data memory instead of a reading time of the display data memory.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a display control unit and a display control method thereof in the present invention will next be described in detail with reference to the accompanying drawings.

Figure 1:
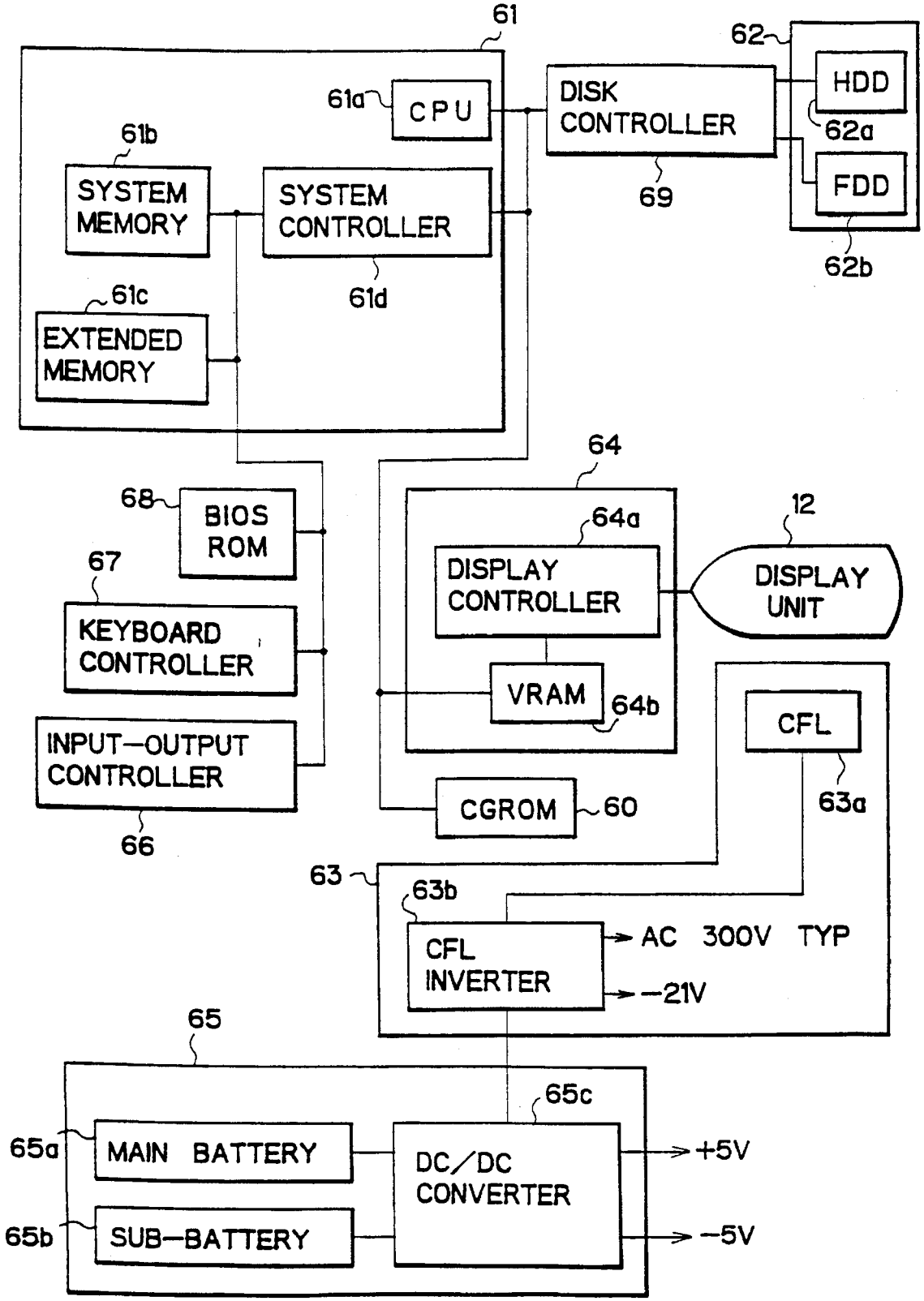
Fig. 1 (PRIOR ART)
FIG. 1 is a block diagram showing the construction of a general personal computer operated by a battery.

FIG. 1 is a block diagram showing the construction of a general personal computer operated by a battery.

In FIG. 1, a central processor 61 is constructed by a central processing unit (CPU) 61*a*, a system memory 61*b*, an extended memory 61*c*, a system controller 61*d*, etc. The central processor 61 controls an entire operation of the personal computer. An external memory unit 62 is comprised of a hard disk unit 62*a*, a floppy disk unit 62*b*, etc. The hard disk unit 62*a* is written as HDD in FIG. 1. The floppy disk unit 62*b* is written as FDD in FIG. 1. The external memory unit 62 stores a program file and a data file. A back light device 63 is constructed by a cold cathode fluorescent lamp (CFL) 63*a*, a CFL inverter 63*b*, etc. The back light device 63 is disposed to irradiate light to a display unit 12 composed of a liquid crystal display (LCD), etc. A display control unit 64 is constructed by a display controller 64*a* and a video RAM 64*b* written as a VRAM in FIG. 1. The display control unit 64 controls a display of data in the display unit 12. A power source device 65 is constructed by a main battery 65*a*, a sub-battery 65*b* and a DC/DC converter 65*c*. The power source device 65 is disposed to supply stable direct current power.

A large amount of power supplied from the power source device 65 is consumed in each of the central processor 61, the external memory unit 62, the back light device 63 and the display control unit 64.

In FIG. 1, an input-output controller 66 controls connections between the central processor 61 and a printer, RS232C and a modem. A keyboard controller 67 controls inputting operations of a keyboard, a keypad having 17 keys, a mouse, etc. A BIOS ROM 68 stores programs for controlling operations of the printer, the external memory unit 62, etc. A disk controller 69 controls inputting and outputting operations of data between the central processor 61 and the external memory unit 62. A character generator 60 stores dot patterns corresponding to character codes. The character generator 50 is written as CGROM in FIG. 1.

Power consumption of the power source device 65 is small in each of the input-output controller 66, the keyboard controller 67, the BIOS ROM 68, the disk controller 69 and the character generator 60.

An explanation about power consumption of the display control unit 54 will next be described particularly.

In general, the display control unit 64 must transfer a control signal and display data to the display unit 12 in a constant period determined by the display unit 12. The display data transferred to the display unit 12 are stored into the video RAM (VRAM) 64*b*. The display controller 64*a* reads the stored data from the video RAM 64*b* and converts the stored display data to data required for the display unit 12 and then transmits the converted data to the display unit 12.

Figure 2:
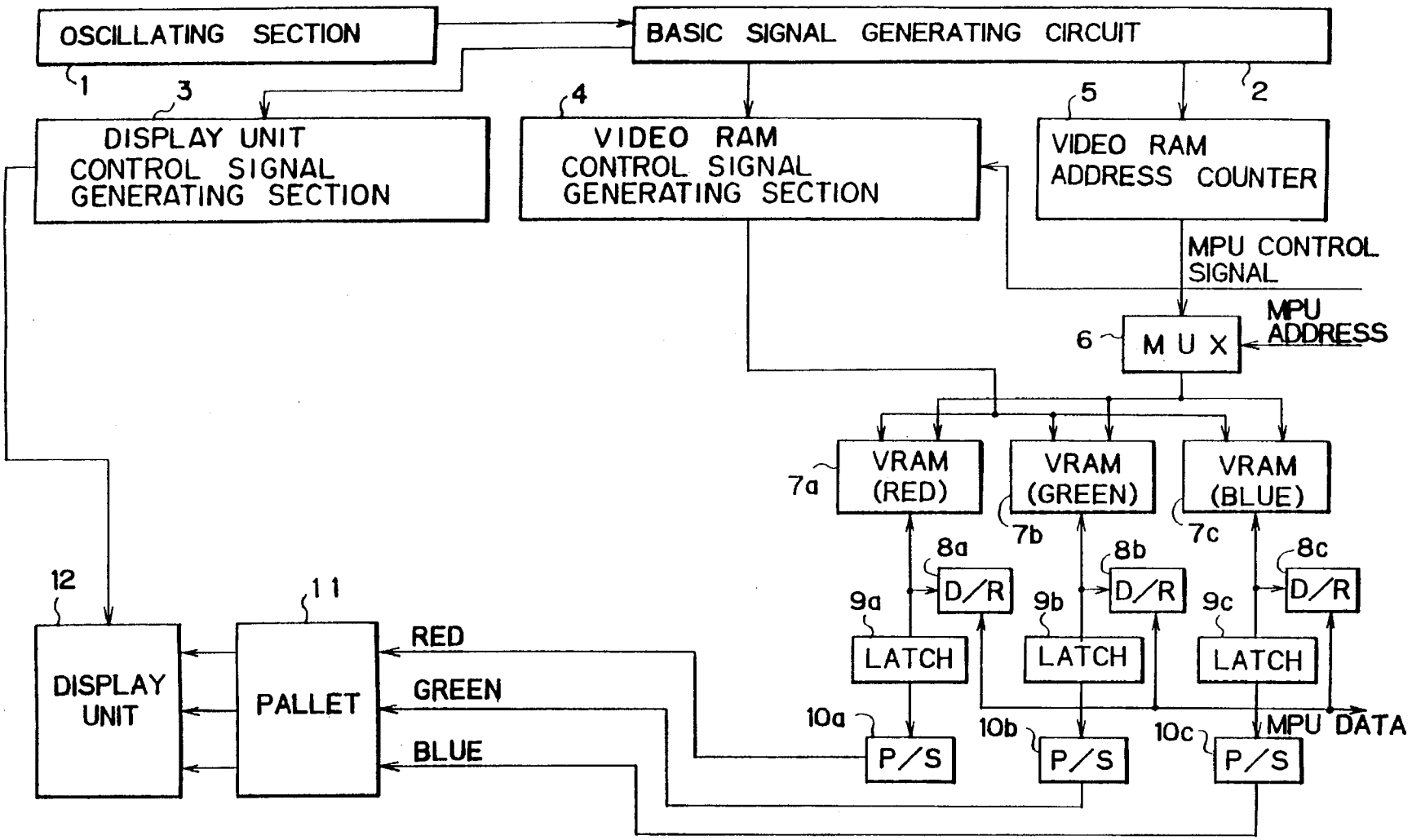
Fig. 2 (PRIOR ART)
FIG. 2 is a block diagram showing a constructional example of a display control unit shown in FIG. 1.

FIG. 2 is a block diagram showing a constructional example of the display control unit in FIG. 1.

FIG. 2, an oscillating section 1 and a basic signal generating circuit 2 generate a basic clock signal for transferring display data and a control signal to the display unit 12 in a predetermined period. A display unit control signal generating section 3 generates a control signal for controlling an operation of the display unit 12 on the basis of this clock signal. A video RAM control signal generating section 4 generates a control signal transmitted to each of video RAMs (VRAMs) 7*a* to 7*c* required to sequentially transmit the display data. A video RAM address counter 5 generates an address of each of the video RAMs (VRAMs) 7*a* to 7*c*. A multiplexer 6 switches addresses of the video RAMs 7*a* to 7*c* by addresses from the video RAM address counter 5 and the central processor when displayed contents are changed. This central processor is written as MPU in FIG. 2. Each of the video RAMs 7*a* to 7*c* stores displayed data. Each of driver-receiver circuits 8*a* to 8*c* is disposed to prevent a line of data for display from being mixed with data buses of the central processor. Each of latch circuits 9*a* to c latches the display data sequentially outputted from each of the video RAMs 7*a* to 7*c*. Each of parallel/serial converters 10*a* to 10*c* converts the display data latched by each of the latch circuits 9*a* to 9*c* from a parallel form to a serial form. A pallet 11 selects a color from the serially converted display data and transmits this color to the display unit 12.

The display controller 64*a* in FIG. 1 is constructed by constructional parts except for the video RAMs 7*a* to 7*c* and the display unit 12 in FIG. 2.

An operation of such a display control unit will next be described.

A predetermined clock signal corresponding to the display unit 12 is generated by the oscillating section 1 and the basic signal generating circuit 2. The display unit control signal generating section 3 generates a control signal for controlling an operation of the display unit 12 based on the basis of this clock signal.

The video RAM control signal generating section 4 generates a control signal for controlling an operation of each of the video RAMs a to 7*c* so as to sequentially transmit display data. Then, the video RAM address counter 5 generates addresses of the video RAMs required for sequential transmission of the display data.

When displayed contents of the display unit 12 are changed, addresses of the video RAMs 7*a* to 7*c* are switched by addresses from the video RAM address counter 5 and the central processor 61 using the multiplexer 6 since these displayed contents are changed by the central processor 61 in FIG. 1.

With respect to a picture displayed by the display unit 12, addresses of the video RAM address counter 5 are set to be relative to those of the video RAMs 7*a* to 7*c* by the multiplexer 6. Each of the video RAMs 7*a* to 7*c* sequentially outputs display data in accordance with commands of the address counter 5. Each of the display data is latched by each of the latch circuits 9*a* to 9*c*. The latched display data are serially converted by the parallel/serial converters 10*a* to 10*c*. The pallet 11 selects colors from these converted data and transmits these colors to the display unit 12.

In such output control of the display data to the display unit 12, the display control unit gets access to the video RAMs 7*a* to 7*c* at any time irrespective of contents thereof as displayed contents of the display unit 12.

The display control unit consumes a large amount of power by reading data from the video RAMs 7*a* and 7*c*.

For example, Japanese Patent Application Laying Open (KOKAI) No. 59-2081 shows a general technique for reducing power consumption of the display control unit. In this technique, power consumption is reduced by generally controlling each of display operations of a composite display plasma display panel (PDP) for providing a plurality of displays such as a segment display, a dot matrix display, etc. For example, Japanese Patent Application Laying Open (KOKAI) No. 2-292629 shows a control operation of the display control unit in which the central processor gets access to the video RAMs. A speed of this control operation is increased by frequently changing addresses of the video RAMs when the display data are accessed.

However, in such a general technique, no access control to the video RAMs is considered with respect to display data in which the same contents are continuously displayed. For example, characters are scattered as a whole when the characters are printed on the left-hand side of a document made by a word processor and blanks are formed on the right-hand side of the document. Characters are also scattered as a whole when table calculating soft or spreadsheet soft is used. In such cases, continuous dots often have the same color in a picture portion of the display unit. In the general technique, data are also read from the video RAMs with respect to such a picture portion in which the same color is continuously displayed, thereby consuming a large amount of power.

Accordingly, when display data are outputted to the display unit in the general technique, the video RAMs are accessed at any time irrespective of displayed contents, i.e., data contents of the video RAMs. Therefore, it is impossible to reduce power consumption of the display control unit by getting access to the video RAMs.

Figure 3A:
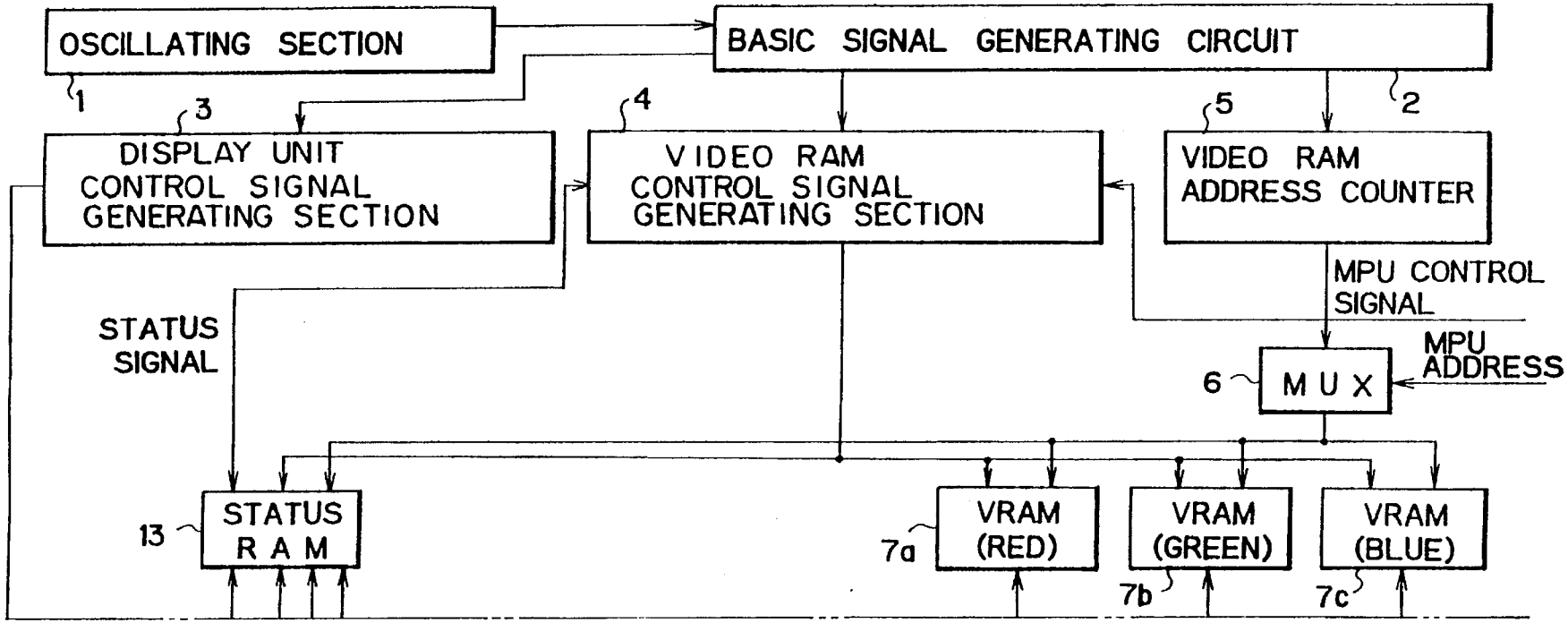
FIGS. 3A–3B are block diagrams showing the construction of a display control unit in accordance with one embodiment of the present invention.
Figure 3B:
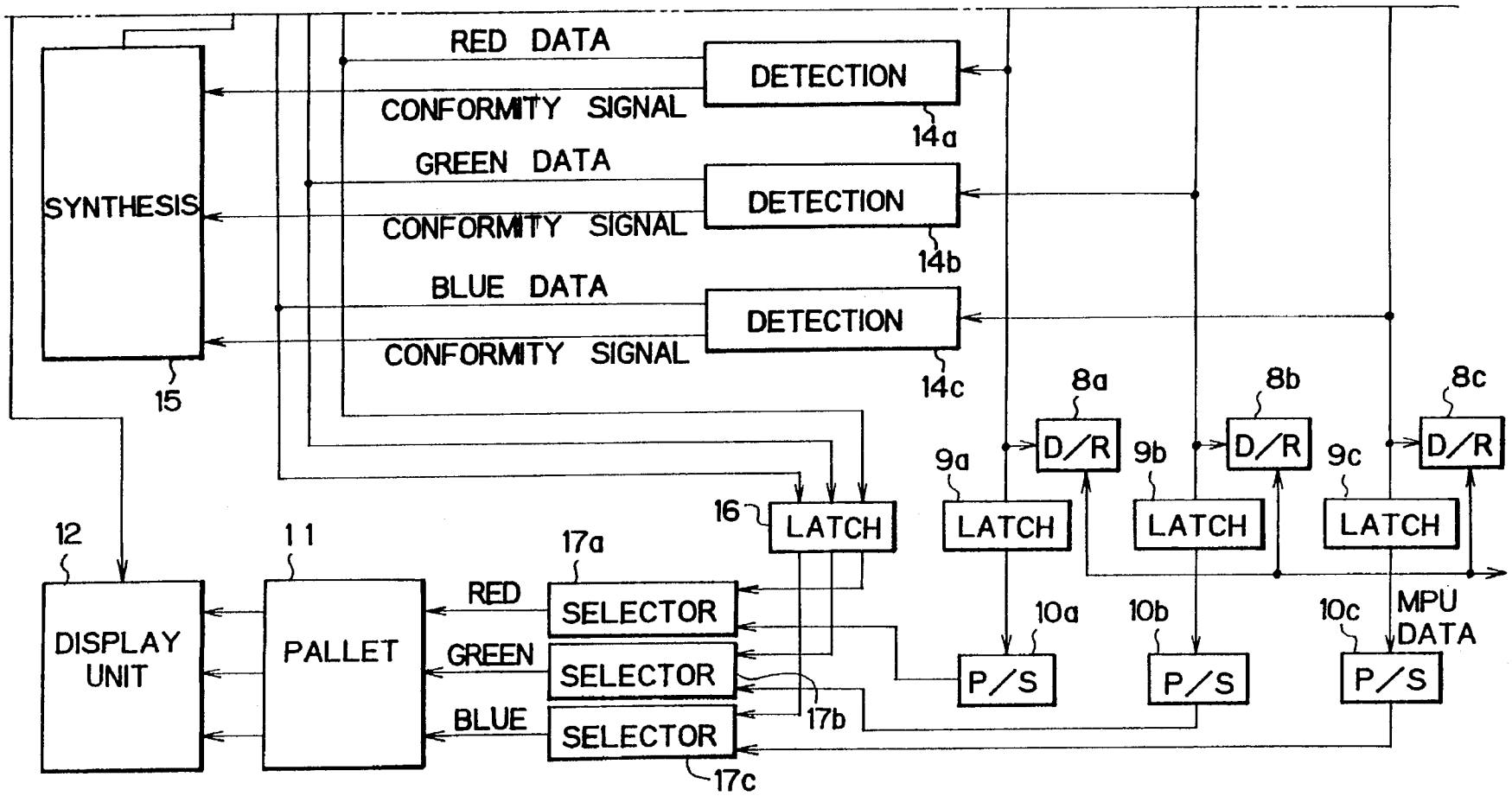

FIGS. 3A–3B are block diagram showing the construction of a display control unit in accordance with one embodiment of the present invention.

In FIG. 3A, a video RAM control signal generating section 4 generates a control signal transmitted to each of video RAMs 7*a* to 7*c* required to sequentially transmit display data. The video RAMs are written as VRAMs in FIG. 3B. The video RAM control signal generating section 4 is operated as a control section of the display control unit in the present invention. A status RAM 13 constitutes a status memory of the present invention for storing operating states of the video RAMs 7*a* to 7*c*. Conformity detecting circuits 14*a* to 14*c* and a synthetic circuit 15 constitute a bit judging section of the present invention. The conformity detecting circuits 14*a* to 14*c* detect whether bits of the video RAMs 7*a* to 7*c* are in conformity with each other or not. Each of the conformity detecting circuits 14*a* to 14*c* outputs conformity and nonconformity signals respectively indicating conformity and nonconformity of these bits. When these bits are in conformity with each other, each of the conformity detecting circuits 14*a* to 14*c* outputs a data line on which display data indicative of this conformity show value "0" or "1". Each of the conformity detecting circuits 14*a* to 14*c* is written as detection in FIG. 3B. The synthetic circuit 15 inputs the conformity signal from each of these conformity detecting circuits 14*a* to 14*c*. The synthetic circuit 15 confirms whether all the conformity signals of the conformity detecting circuits 14*a* to 14*c* with respect to the respective video RAMs 7*a* to 7*c* are in conformity with each other or not. The synthetic circuit 15 transmits information of the confirming results to the status RAM 13 as a status signal. The synthetic circuit 15 is written as synthesis in FIG. 3B. A latch circuit 16 latches data from the status RAM 13. Each of selectors 17*a* to 17*c* selects data outputted to a display unit 12. In the display control unit in this embodiment, the above-mentioned constructional circuits are newly disposed in the general display control unit shown in FIG. 2.

An oscillating section 1, a basic signal generating circuit 2, a display unit control signal generating section 3, a video RAM address counter 5, a multiplexer 6, video RAMs 7*a* to 7*c*, driver-receiver circuits 8*a* to 8*c*, latch circuits 9*a* to 9*c*, parallel/serial converters 10*a* to 10*c* and a pallet 11 are similar to those in the general display control unit shown in FIG. 2. Accordingly, for brevity, an explanation of these constructional elements is omitted in the following description. In FIG. 3A, the multiplexer 6, each of the video RAMs 7*a* to 7*c*, each of the driver-receiver circuits 8*a* to 8*c*, each of the latch circuits 9*a* to 9*c* and each of the parallel/serial converters 10*a* to 10*c* are respectively written as MUX, VRAM, D/R, LATCH and P/S.

The display controller shown in FIG. 1 is constructed by constructional parts except for the video RAMs 7*a* to 7*c* and the display unit 12 in FIG. 3A.

An operation of the display control unit in this embodiment of the present invention will next be explained.

An unillustrated central processor (MPU) first writes display data to each of the video RAMs 7*a* to 7*c*. In this case, the display data of the video RAMs 7*a* to 7*c* are respectively inputted to the conformity detecting circuits 14*a* to 14*c*. Each of the conformity detecting circuits 14*a* to 14*c* judges whether all bits of the display data written by the central processor are in conformity with each other or not. Simultaneously, the video RAM control signal generating section 4 transmits a writing control signal to the status RAM 13 so that information of each of the conformity detecting circuits 14*a* to 14*c* is written to the status RAM 13. At this time, addresses of the status RAM 13 show MPU addresses from the central processor through the multiplexer 6 as shown in FIG. 3A.

When display data are written to all RAM addresses (1 to 19200 in FIG. 5) from the central processor, correct information are also written to all addresses of the status RAM 13.

The central processor normally clears a screen of the display unit when a power source is turned on. At this time, information of the status RAM 13 is set to be correct information with respect to all the addresses. Subsequently, data contents of the status RAM 13 are rewritten every time data are rewritten to each of the video RAMs 7*a* to 7*c* from the central processor.

When a picture is outputted, the video RAM address counter 5 outputs addresses to the status RAM 13 through the multiplexer 6. The video RAM control signal generating section 4 outputs a reading control signal of the status RAM 13 to read a status signal outputted from the status RAM 13.

If this status signal shows value "1", no video RAM control signal generating section 4 outputs the reading control signal to each of the video RAMs 7*a* to 7*c*. Data outputted from the status RAM 13 are latched by the latch circuit 16. The latched data of the latch circuit 16 are outputted to the display unit 12 by the selectors 17*a* to 17*c*.

In contrast to this, if the status signal shows value "0", the video RAM control signal generating section 4 outputs the reading control signal to each of the video RAMs 7*a* to 7*c*. Display data are outputted from each of the video RAMs 7*a* to 7*c* as in the general display control unit. The display data are then outputted to the selectors 17*a* to 17*c* through the latch circuits 9*a* to 9*c* and the parallel/serial converters 10*a* and 10*c*. In this case, the display data from the parallel/serial converters 10*a* to 10*c* are outputted to the display unit 12 by the selectors 17*a* and 17*c*.

When bits of the video RAMs 7*a* to 7*c* are in conformity with each other, the display data can be transmitted to the display unit 12 without getting access to each of the video RAMs 7*a* to 7*c*.

A circuit section from the video RAMs 7*a* to 7*c* to the parallel/serial converters 10*a* to 10*c* for serially converting the display data is operated at a high frequency so that power consumption is large in this circuit section. However, in the display control unit in this embodiment, this power consumption can be set to be zero when the status RAM 13 outputs data value "1".

For example, in this operation of the display control unit, all data can be once read temporarily from each of the video RAMs 7*a* to 7*c* in FIG. 3A when the display data are read. At this time, it is possible to write registered contents of the status RAM 13 shown in FIG. 3A. In this case, when data contents of the video RAMs are rewritten by the central processor, only a conformity signal of the status RAM 13 is temporarily rewritten to value "0". This conformity signal is shown by bit b3 in FIG. 7 described later. However, in this case, a written value from the central processor is once set to "0" even when the conformity signal of the status RAM shows data value "1". Therefore, data of each of the video RAMs are uselessly read therefrom.

Figure 4:
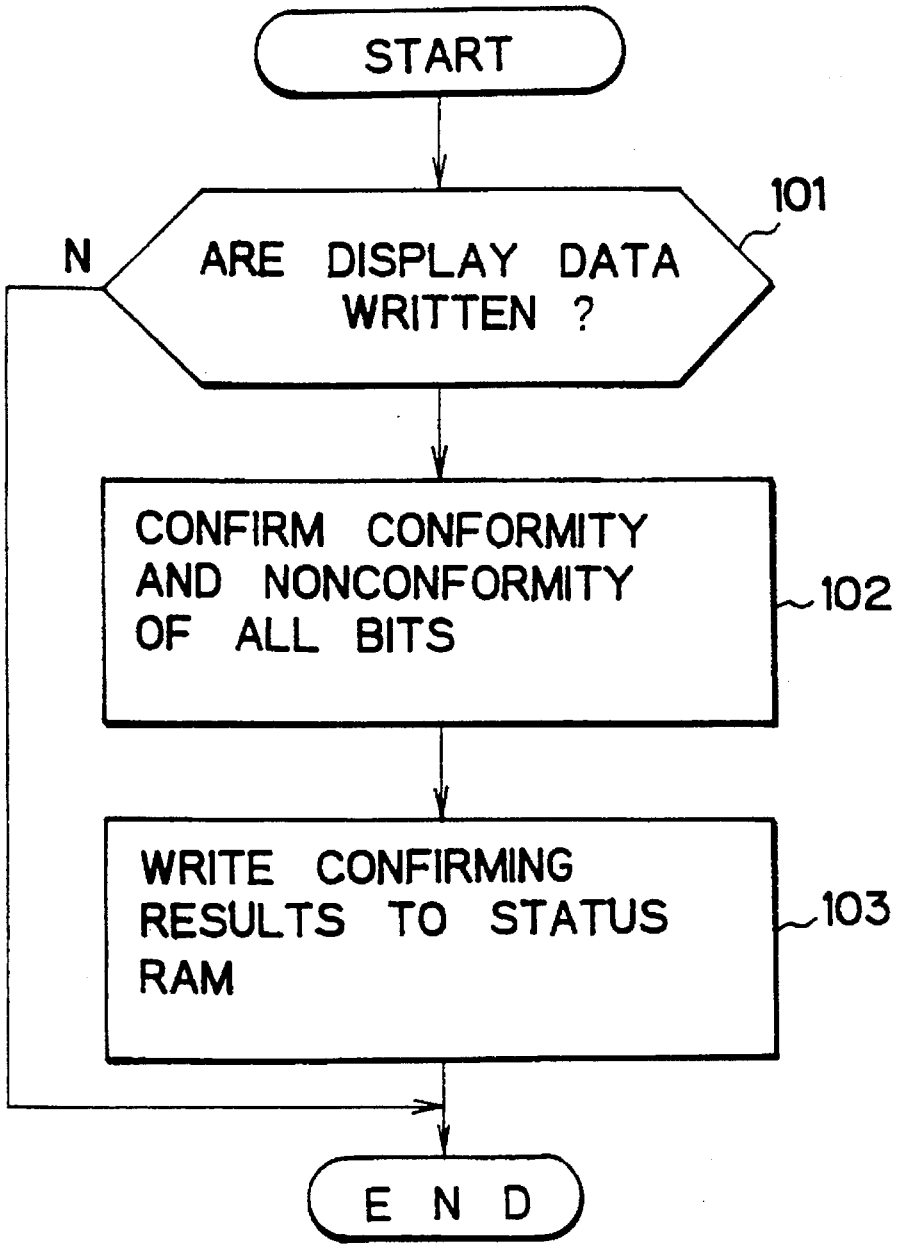
FIG. 4 is a flow chart showing one example of a processing operation of the display control unit shown in FIGS. 3A–3B in relation to the present invention.

Accordingly, as shown in FIG. 4, power consumption can be further reduced by rewriting data contents of the status RAM 13 at a writing timing at which the central processor writes data to each of the video RAMs 7*a* to 7*c*.

FIG. 4 is a flow chart showing one example of a processing operation of the display control unit shown in FIG. 3A–3B in relation to the present invention.

FIG. 4 shows a registering timing of data registered to the status RAM 13 shown in FIG. 3A. When the central processor writes display data to each of the video RAMs 7*a* to 7*c* in a step 101, the display data of the video RAMs 7*a* to 7*c* are respectively inputted to the conformity detecting circuits 14*a* to 14*c* shown in FIG. 3B. In a step 102, the conformity detecting circuits 14*a* to 14*c* judge whether all bits of the display data written by the central processor are in conformity with each other or not. In a step 103, the judging results are written to the status RAM 13 on the basis of a control signal from the video RAM control signal generating section 4 in FIG. 3A.

Figure 5:
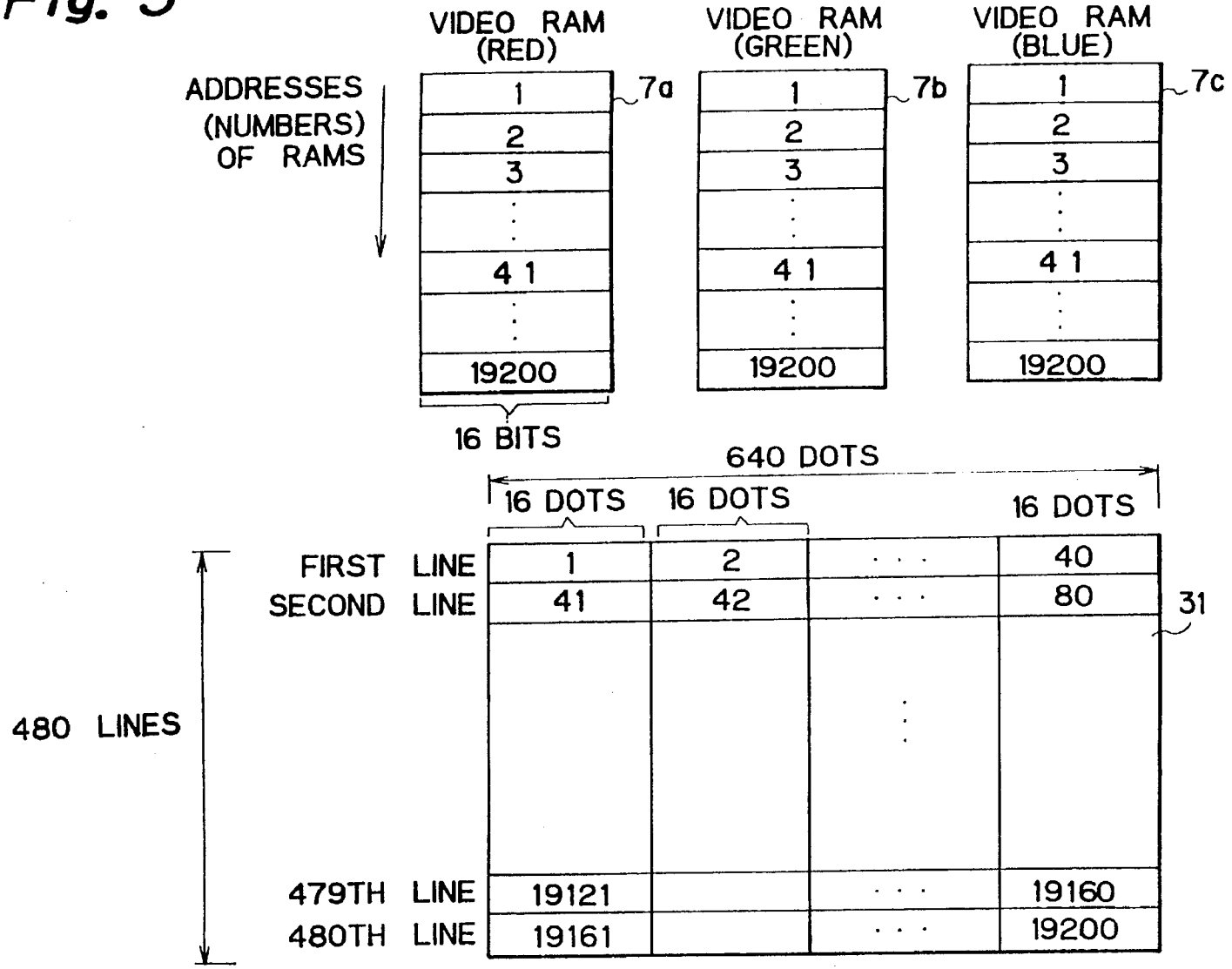
FIG. 5 is an explanatory view showing an example in which video RAMs shown in FIG. 3A correspond to the screen of a display unit.

FIG. 5 is an explanatory view showing an example in which the video RAMs correspond to the screen of the display unit in FIG. 3B.

In this example, the screen 31 of the display unit 12 shown in FIG. 3B has a size of 540×480 dots. The display unit 12 shown in FIG. 3B sequentially displays images from a left-hand side of the screen 31 on a first line thereof. Accordingly, the display control unit shown in FIGS. 3A–3B sequentially reads data from the video RAMs 7*a* to 7*c* corresponding to a left-hand side of the screen on the first line. The read data are converted to data required for the display unit 12 shown in FIG. 3B and are transmitted to this display unit 12.

Accordingly, the display unit 12 in FIG. 3B sequentially reads data from the video RAMs 7*a* to 7*c* in an address order of "1, 2, 3, - - - , 19200". After the display unit 12 reads data of the video RAMs 7*a* to 7*c* at the address of "19200", the display unit 12 sequentially reads data of the video RAMs from the address of "1" again.

The display control unit shown in FIGS. 3A–3B consumes a large amount of electric currents by performing such a reading operation of data of the video RAMs 7*a* to 7*c*.

Figure 6:
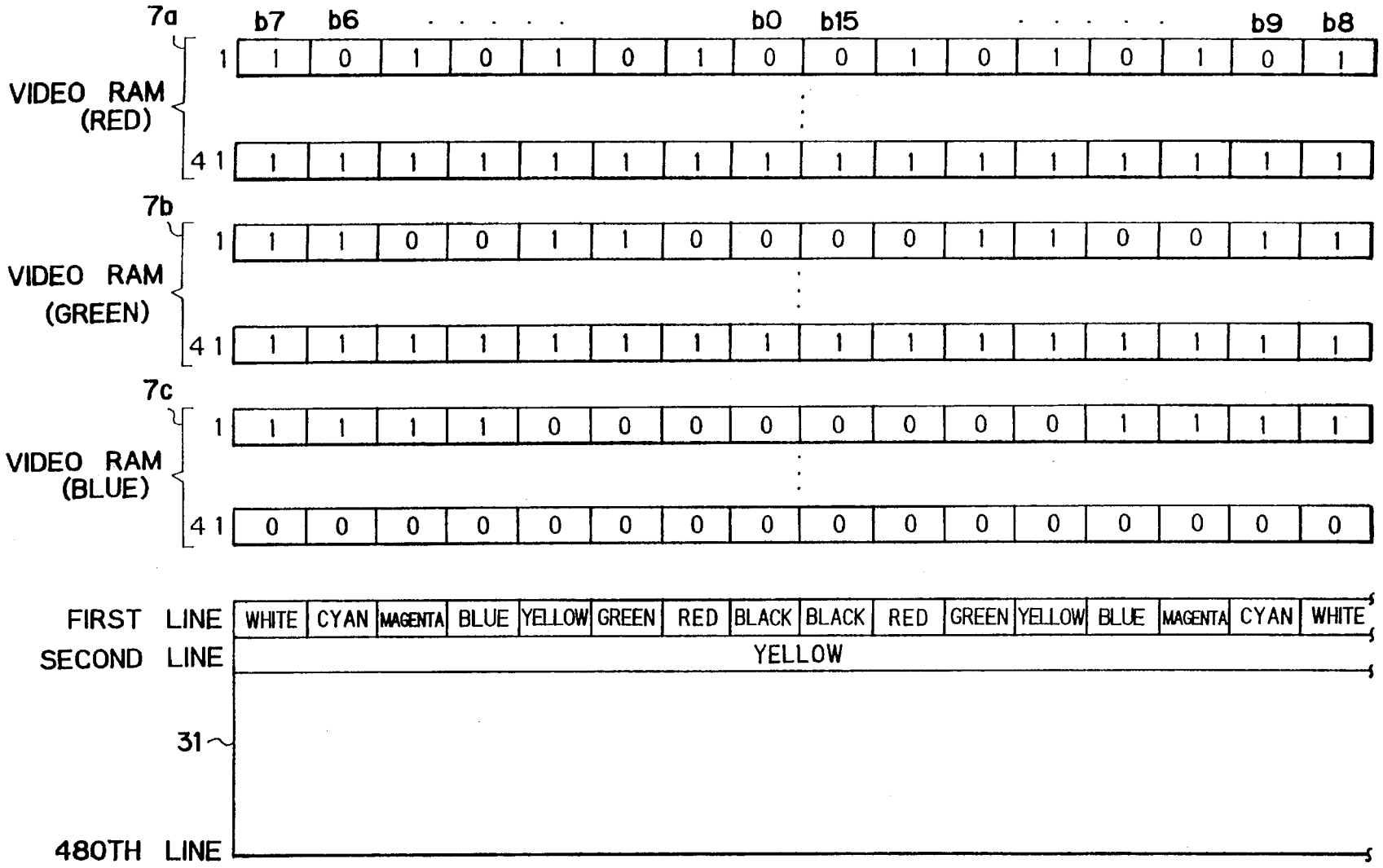
FIG. 6 is an explanatory view showing an example in which the video RAMs shown in FIG. 3B correspond to pictures on the screen of the display unit by providing concrete numeric values.

As shown in FIG. 6, each of the video RAMs 7*a* to 7*c* can control display contents of the screen 31 every one dot.

FIG. 6 is an explanatory view showing an example in which the video RAMs shown in FIG. 3B correspond to pictures on the screen of the display unit by providing concrete numeric values.

In FIG. 6, colors are different from each other on a first line of the screen 31 every one dot. Yellow is continuously displayed on a second line of the screen 31.

When the screen 31 is really seen and colors are different from each other every one dot, characters, etc. are displayed and a pattern is displayed on a background.

The entire screen 31 is scarcely filled with characters. For example, when a document is made by a word processor, there is a case in which characters are located on the left-hand side of the screen and blanks are formed on the right-hand side of the screen even when blank lines are formed and the characters are displayed. In another case, characters are scattered as a whole when table calculating soft or spreadsheet soft is used.

Blank lines are formed at any time to discriminate characters from each other even when the characters are located on one side of the screen.

When the background is formed by an excessively fine pattern and is displayed, the background is flickered and it is very difficult for an operator to sec characters, etc. on the background. Accordingly, the background is normally displayed by combining patterns colored in a certain color with each other.

As mentioned above, continuous dots normally have the same color as shown on the second line of the screen 31. In this embodiment, this color is set to yellow.

In this embodiment shown in FIGS. 3A–3B, the display control unit makes display data transmitted to the display unit without reading data from the video RAMs 7*a* to 7*c* with respect to an image portion in which the same color is continuously displayed. Thus, it is possible to save power of the display control unit.

Figure 7:
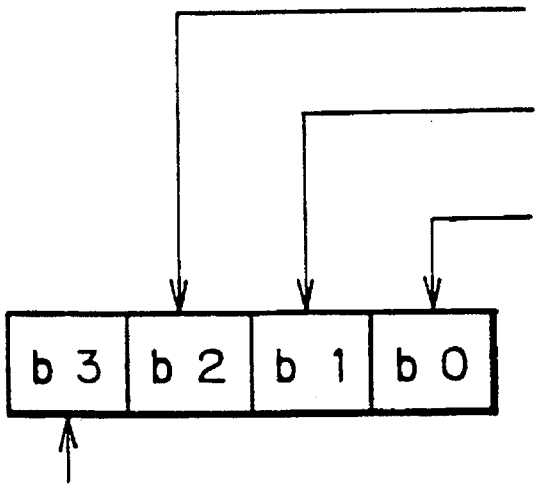
FIG. 7 is an explanatory view showing one example of registered contents of a status RAM shown in FIG. 3B.

FIG. 7 is an explanatory view showing one example of registered contents of the status RAM shown in FIG. 3A.

In FIG. 7, a registered bit b3 shows that all bit information of each of the video RAMs 7*a* to 7*c* shown in FIG. 3A are the same. For example, when all the bit information are the same, this bit b3 is set to a registered value of "1". In contrast to this, when these bit information are different from each other, this bit b3 is set to a registered value of "0".

When the bit b3 is set to value "1", a bit kind of each of the video RAMs 7*a* to 7*c* shown in FIG. 3A is registered as each of b2, bl and b0.

In FIG. 7, an arrow directed to b0 shows red data provided when b3 is set to "1". An arrow directed to bl shows green data provided when b3 is set to "1". An arrow directed to b2 shows blue data provided when b3 is set to "1". As mentioned above, b3 is a bit showing that all bit information of each of the graphic RAMs for red, green and blue are the same. Further, b3 is set to "1" or "0" according to whether the bit information are respectively the same or different.

For example, each of addresses 41 of the video RAMs 7*a* to 7*c* shows a leading address of data on a second line of the screen 31 read at one time in FIG. 6. All bits of the video RAM 7*a* for red are set to value "1" at address 41 of this video RAM 7*a*. All bits of the video RAM 7*b* for green are set to value "1" at address 41 of this video RAM 7*b*. All bits of the video RAM 7*c* for blue are set to value "0" at address 41 of this video RAM 7*c*. Accordingly, bit b3 of the status RAM 13 at address 41 thereof shown in FIG. 3A is set to value "1". Each of first addresses of the video RAMs 7*a* to 7*c* shows a leading address on a first line of the screen 31 in FIG. 6. Sixteen bits of the video RAM 7*a* at its first address are not equal to each other. Sixteen bits of the video RAM 7*b* at its first address are not equal to each other. Sixteen bits of the video RAM 7*c* at its first address are not equal to each other. Namely, these 16 bits of each of the video RAMs 7*a* to 7*c* do not have the same value at addresses 1 thereof. Therefore, bit b3 of the status RAM 13 in FIG. 3A at its first address is set to "0".

Power consumption reduced by the above structure of the display control unit will next be described.

Power of a RAM is determined by the number of read bits. Therefore, power for reading data from the status RAM 13 in FIG. 3A is equal to $4/(16\times3)=1/12$ times power for reading data from the video RAMs 7*a* to 7*c* in FIG. 3A. Accordingly, the power for reading data from the status RAM 13 in FIG. 3A is much smaller than the power for reading data from the video RAMs 7*a* to 7*c* in FIG. 3A.

For example, in accordance with the screen structure shown in FIG. 5, the status RAM 13 in FIG. 3A is constructed by 19200×4 bits=76.8 k bits.

In contrast to this, each of the video RAMs 7*a* to 7*c* is constructed by 19200×16 bits=307.2 k bits.

This bit number of each of the video RAMs 7*a* to 7*c* is totally multiplied three times as follows with respect to three colors of red, green and blue.

307.2 k bits×3=921.6 k bits

A memory capacity of the status RAM 13 in FIG. 3A is smaller than that of each of the video RAMs 7*a* to 7*c* in FIG. 3A. Accordingly, as shown in FIG. 3A, it is not necessary to separate the video RAMs 7*a* to 7*c* from the other control parts such as the video RAM control signal generating section 4. Therefore, the video RAMs can be assembled into the same integrated circuit (IC) in a form in which the video RAMs are built in a control section of the display control unit.

When the video RAMs are assembled into the same integrated circuit (IC), it is possible to reduce driving power required for data and address lines for getting access to the video RAMs. Accordingly, power of the display control unit can be further reduced.

As explained with reference to FIGS. 3A to 7, in the display control unit of the present invention, if all bits of display data read at one time are the same, a reading operation of the display data is stopped with respect to each of video RAMs and data are read from a status RAM. Accordingly, it is not necessary to get access to the video RAMs. Therefore, power consumption of each of the video RAMs can be reduced. Further, it is possible to reduce power consumption in a circuit portion operated at a high frequency until data of the video RAMs are converted to serial data.

Further, control parts and the status RAM can be assembled into the same integrated circuit. Accordingly, it is not necessary to dispose an output driver constructed by an integrated circuit consuming a large amount of electric currents when the status RAM is accessed. Therefore, power for getting access to the status HAM can be reduced in comparison with a case in which the control parts and the status RAM are constructed by separate integrated circuits.

The present invention is not limited to the embodiments shown in FIGS. 3A to 7, but can be changed in various kinds of modifications without departing from the features of the present invention.

In accordance with the present invention, when display data are outputted to the display unit, no data are read from the video RAMs with respect to an image portion in which the same contents are continuously displayed. Accordingly, the number of accessing operations to the video RAMs can be reduced so that power of the display control unit can be saved.

Many widely different embodiments of the present invention may be constructed without departing from the spirit and scope of the present invention. It should be understood that the present invention is not limited to the specific embodiments described in the specification, except as defined in the appended claims.

What is claimed is:

1. A display control unit comprising:

a display data memory for storing display data displayed in pixels of a display unit; and control means for repeatedly reading the display data stored to the display data memory when the display data are outputted to said display unit;

said control means including:

bit judging means for judging whether all bits of the display data read at one time from said display data memory are the same or not; and a status memory for storing judging results of the bit judging means and a bit kind of the display data judged as the same bits;

said control means confirming registered contents of said status memory and reading the bit kind registered to said status memory instead of the display data stored to said display data memory when all the bits of said display data are the same.

2. A display control unit as claimed in claim 1, wherein said control means and said status memory are constructed by one IC chip.

3. A display control unit according to claim 1, wherein, said bits read by said control means at one time correspond to a line of the display data;

wherein, said control means causes the display data memory to output the stored display data when all pixels of a current line of the display data are not represented by a same binary combination; and wherein, said control means causes the status memory to output the bit kind when all the pixels of the current line of the display data are represented by the same binary combination.

4. A display control unit according to claim 3, wherein, said binary combination for each pixel comprise three bits representing the colors red, green and blue.

5. A method for controlling the operation of a display control unit, said display control unit comprising:

a display data memory for storing display data displayed in pixels of a display unit; and control means for repeatedly reading the display data stored to the display data memory when the display data are outputted to said display unit;

said control means including:

bit judging means for judging whether all bits of the display data read at one time from said display data memory are the same or not; and, a status memory for storing judging results of the bit judging means and a bit kind of the display data judged as the same bits;

said display control method comprising the steps of:

confirming registered contents of said status memory by the control means and reading the bit kind registered to said status memory by the control means instead of the display data stored to said display data memory when all the bits of said display data are the same; and performing a registering operation of said status memory when the display data are stored to said display data memory.

6. A display control method as claimed in claim 5, wherein said control means and said status memory are constructed by one IC chip.

* * * * *